US006767298B2

(12) United States Patent
Tsai

(10) Patent No.: US 6,767,298 B2
(45) Date of Patent: Jul. 27, 2004

(54) BUFFERING AND SHOCK-ABSORBING STRUCTURE FOR RACKET STRING

(76) Inventor: Steven Tsai, No. 30, Lane 98, Yeong-Jsing St.., Taichung City (TW)

( * ) Notice: Subject to any disclaimer, the term of this patent is extended or adjusted under 35 U.S.C. 154(b) by 0 days.

(21) Appl. No.: 10/386,498

(22) Filed: Mar. 13, 2003

(65) Prior Publication Data

US 2003/0232670 A1 Dec. 18, 2003

(30) Foreign Application Priority Data

Jun. 12, 2002 (TW) ..... 91208753 U

(51) Int. Cl.[7] ..... A63B 49/02
(52) U.S. Cl. ..... 473/522
(58) Field of Search ..... 473/520–522, 473/524, 539, 540

(56) References Cited

U.S. PATENT DOCUMENTS 4,750,742 A * 6/1988 Coupar ..... 473/540
4,828,259 A * 5/1989 Davis ..... 473/522
4,909,511 A * 3/1990 DeVille et al. ..... 473/522
4,993,711 A * 2/1991 Deville et al. ..... 473/522
5,165,687 A * 11/1992 Soong ..... 473/521
6,319,158 B1 * 11/2001 Cheng ..... 473/522
6,540,626 B1 * 4/2003 Tsai ..... 473/540

* cited by examiner

*Primary Examiner*—Raleigh W. Chiu
(74) *Attorney, Agent, or Firm*—Troxell Law Office PLLC

(57) ABSTRACT

A buffering and shock-absorbing structure for racket string including: a frame section having an inner frame face on inner circumference and an outer frame face on outer circumference, a receiving channel with a predetermined depth being formed on the inner frame face, at least one string hole outward extending through the frame section from the bottom of the receiving channel to the outer frame face of the frame section; at least one tubular grommet coaxially fitted in the string hole; a racket string inserted through the grommet, one end of the racket string extending out of the grommet through the receiving channel and extending out of the open end of the receiving channel from the frame section; and at least one buffering and shock-absorbing section located in the receiving channel. Each of the at least one buffering and shock-absorbing section is located between one of two side walls of the receiving channel and one side of the racket string.

3 Claims, 4 Drawing Sheets

BUFFERING AND SHOCK-ABSORBING STRUCTURE FOR RACKET STRING

BACKGROUND OF THE INVENTION

The present invention is related to a sport implement, and more particularly to a buffering and shock-absorbing structure for racket string.

The conventional racket is equipped with a buffering member for achieving shock-absorbing effect. When hitting a ball, the buffering member serves to prevent the reaction force exerted onto the racket from being directly transmitted to the hand of a player and thus avoid injury of the player.

The above buffering and shock-absorbing structure cannot achieve optimal shock-absorbing effect for the racket. This is because that the buffering and shock-absorbing structure is deformed to buffer the external force. The resilient buffering structure is compressed and deformed by the tensioned string and thus fixed. Under such circumstance, naturally, the buffering ability of the buffering member is reduced. As a result, when hitting the ball, the reaction force may still lead to injury of the player.

SUMMARY OF THE INVENTION

It is therefore a primary object of the present invention to provide a buffering and shock-absorbing structure for racket string, which can provide good buffering and shock-absorbing effect to protect a player from being injured by the reaction force when hitting a ball.

It is a further object of the present invention to provide the above buffering and shock-absorbing structure for racket string, which has a simple structure and is easy to process.

According to the above objects, the buffering and shock-absorbing structure for racket string of the present invention includes: a frame section having an inner frame face on inner circumference and an outer frame face on outer circumference, a receiving channel with a predetermined depth being formed on the inner frame face, at least one string hole outward extending through the frame section from the bottom of the receiving channel to the outer frame face of the frame section; at least one tubular grommet coaxially fitted in the at least one string hole; racket string inserted through the at least one grommet, one end of the racket string extending out of the grommet through the receiving channel and extending out of the open end of the receiving channel from the frame section; and at least one buffering and shock-absorbing section disposed in the receiving channel. Two opposite sides of the buffering and shock-absorbing section respectively abut against a corresponding side wall of the receiving channel and one side of the racket string.

The present invention can be best understood through the following description and accompanying drawings wherein:

DETAILED DESCRIPTION OF THE PREFERRED EMBODIMENTS

Figure 1:
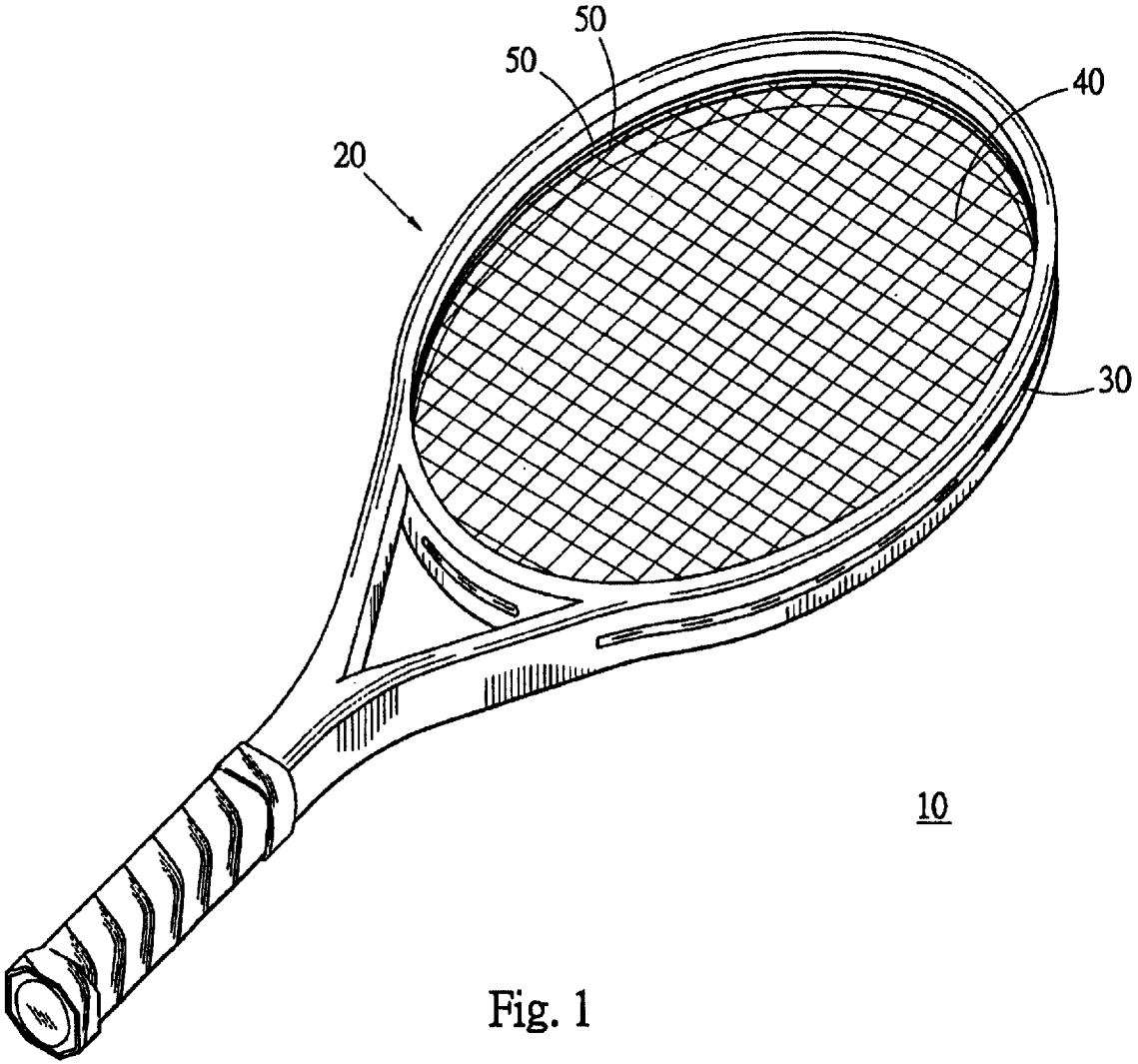
FIG. 1 is a perspective view showing that a first embodiment of the present invention is applied to a racket.
Figure 2:
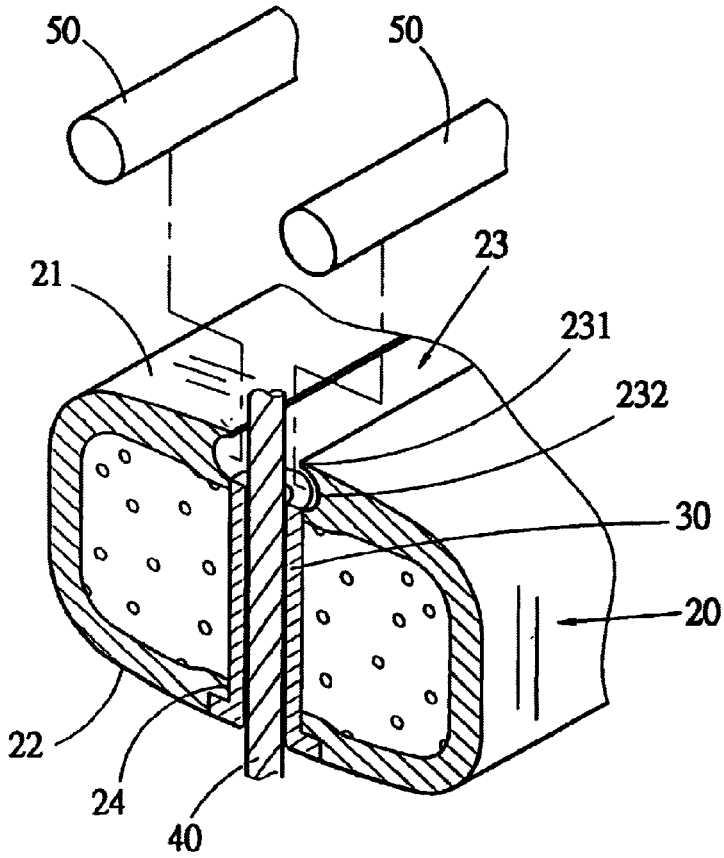
FIG. 2 is a sectional and perspective exploded view of the first embodiment of the present invention.
Figure 3:
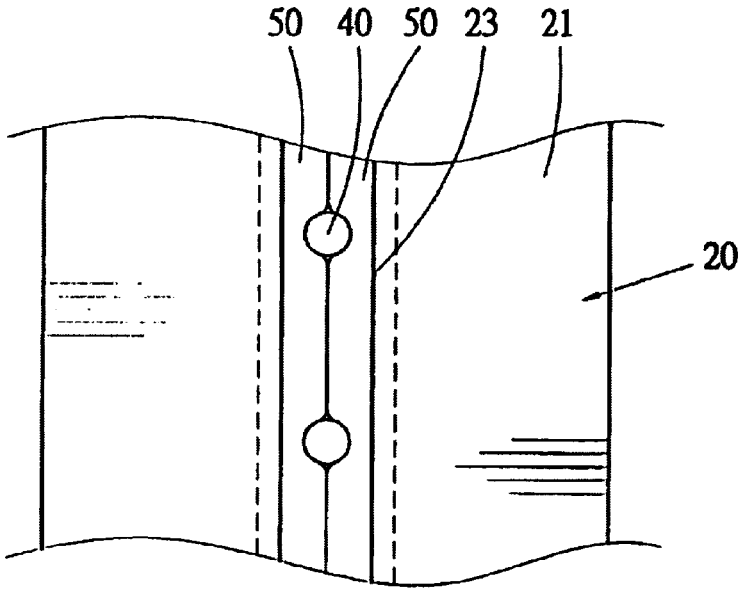
FIG. 3 is a side view of the first embodiment of the present invention.
Figure 4:
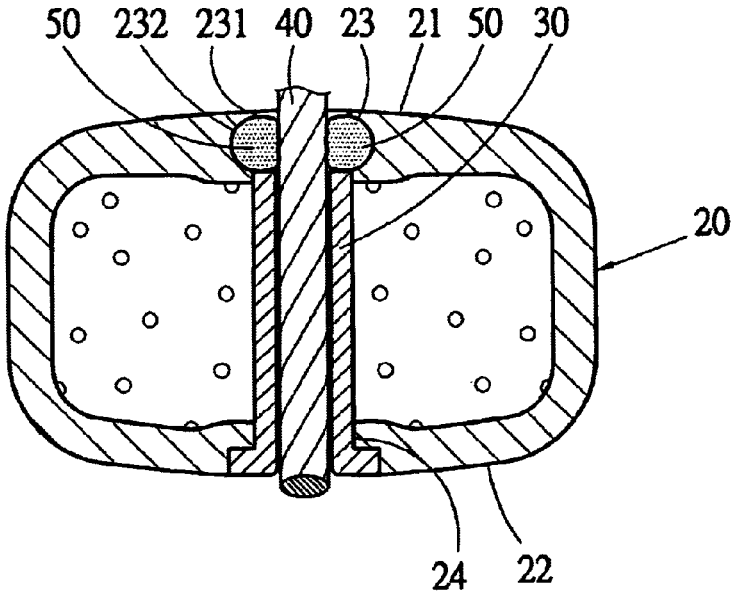
FIG. 4 is a sectional view of the first embodiment of the present invention.

Please refer to FIGS. 1 to 4. According to a first embodiment, the buffering and shock-absorbing structure 10 for racket string of the present invention includes a frame section 20, grommets 30, racket string 40 and two buffering and shock-absorbing sections 50. The frame section 20, grommets 30 and racket string 40 form the first embodiment as shown in FIG. 1.

The frame section 20 is made of a predetermined material and has an inner frame face 21 on an inner circumference of the annular frame section 20 and an outer frame face 22 on an outer circumference of the annular frame section 20. The inner frame face 21 is formed with a receiving channel 23 extending along the inner circumference of the frame section 20. An inner diameter of an open end 231 of the receiving channel 23 is smaller than an inner diameter of a channel body 232. Multiple string holes 24 extend through the frame section 20 from the bottom of the receiving channel 23 to the outer frame face 22 of the frame section 20.

Each grommet 30 is a hollow tubular body axially fitted in one corresponding string hole 24. One end of each grommet 30 is positioned in an opening of each string hole 24 on the outer frame face 22, while the other end of each grommet 30 is positioned in an opening of the string hole 24 on the bottom of the receiving channel 23.

The racket string 40 is inserted through the at least one grommet 30 and positioned in the receiving channel 23. Two sides of an outer periphery of the string 40 are spaced from two side walls of the receiving channel 23 by a predetermined distance.

The buffering and shock-absorbing section 5 is a resiliently compressible strip with a predetermined length. The outer diameter of the strip is larger than the distance between two sides of the string 40 and the side walls of the receiving channel 23. The buffering and shock-absorbing sections 50 are located in the receiving channel 23 between two sides of the string 40 and the side walls of the receiving channel 23. The axes of the buffering and shock-absorbing sections 50 are parallel to the receiving channel 23.

Accordingly, the buffering and shock-absorbing sections 50 are located in the receiving channel 23 on two sides of the string 40. The opening of the receiving channel 23 is small so that the two buffering and shock-absorbing sections 50 are properly located. In addition, the outer diameter of the buffering and shock-absorbing section 50 is larger than the distance between two sides of the string 40 and the side walls of the receiving channel 23 so that the buffering and shock-absorbing sections 50 are tightly associated with the string 40. Accordingly, when the string 40 receives a shock due to an external force, the buffering and shock-absorbing sections 50 can absorb the force exerted onto the string 40 so as to prevent the force from being transmitted to other parts of the racket, especially the handle of the racket. Thereby minimizing a possibility of sport injury.

Furthermore, the buffering and shock-absorbing sections 50 are inlaid in the lateral spaces of the receiving channel 23 divided by the string 40 by a non-damaging measure. Also, the compression of the buffering and shock-absorbing sections 50 are small. In use, the process is simple and a general sport player can place the buffering and shock-absorbing sections 50 into the receiving channel 23. Even if the racket string is replaced, the buffering and shock-absorbing sections 50 can be applied to the racket with the new string to keep the buffering and shock-absorbing effect and protect the player.

The buffering and shock-absorbing sections 50 are located on the entire racket frame section to achieve best buffering and shock-absorbing effect. However, some players want to feel the impact of the ball when hitting the ball. With respect to such actual demand, the number and position of the buffering and shock-absorbing sections 50 can be selectively changed. For example, one single buffering and shock-absorbing section can be located in the receiving channel on one side of the string. Alternatively, the buffering and shock-absorbing sections 50 can be located only at three, six and nine o'clock positions of the racket.

Figure 5:
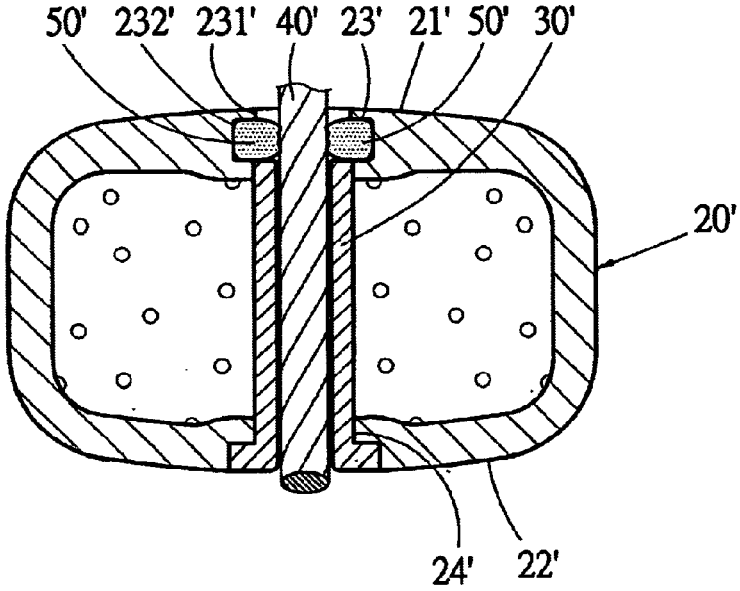
FIG. 5 is a sectional view of a second embodiment of the present invention.
Figure 6:
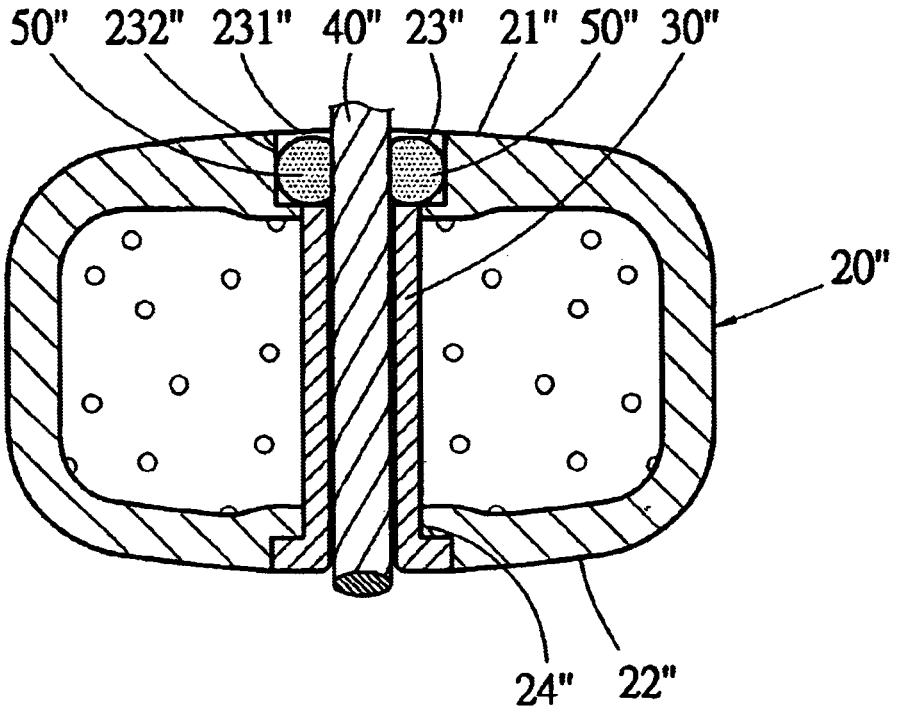
FIG. 6 is a sectional view of a third embodiment of the present invention.

FIGS. 5 and 6 show different shapes of the receiving channels 23. The shape of the receiving channel can be changed. Alternatively, the ratio of the inner diameter of the opening of the receiving channel to the inner diameter of the channel body can be changed. In all these designs, two sides of the string and the side walls of the receiving channel are spaced by a selected distance for inlaying the buffering and shock-absorbing sections 50 therein. Accordingly, the buffering and shock-absorbing sections 50 tightly abut against two sides of the string to absorb the external force exerted into the string and achieve an optimal buffering and shock-absorbing effect. In other words, the shape and structure of the receiving channel is simple such that the resilient buffering and shock-absorbing sections can be property located.

The above embodiments are only used to illustrate the present invention, not intended to limit the scope thereof. Many modifications of the above embodiments can be made without departing from the spirit of the present invention.

What is claimed is:

1. A buffering and shock-absorbing structure for racket strings comprising:

a frame section having an inner frame face on an inner circumference of the frame section and an outer frame face on an outer circumference of the frame section, a receiving channel with a channel body formed on the inner frame face and having a predetermined depth, a plurality of string holes extending through the frame section from a bottom of the receiving channel to the outer frame face of the frame section;

a tubular grommet inserted into each of the plurality of string holes;

a racket string inserted through each of the grommets, one end of the racket string extending out of each grommet through the receiving channel from the frame section; and two buffering and shock-absorbing sections, each located in the receiving channel between the racket string and one of the two side walls of the receiving channel, each buffering and shock-absorbing section having a cylindrical configuration with a cross-sectional dimension less than a distance between the two side walls of the receiving channel.

2. The buffering and shock-absorbing structure according to claim 1, wherein a distance between the racket string and each of the two side walls of the receiving channel is smaller than the cross-sectional dimensions of the buffering and shock-absorbing sections.

3. The buffering and shock-absorbing structure according to claim 1, wherein one end of each grommet is positioned adjacent to the receiving channel.

* * * * *